United States Patent [19]

Brautovich

[11] 4,146,235

[45] Mar. 27, 1979

[54] BOARD GAME

[76] Inventor: John J. Brautovich, 1200 Dake Ave. #149, Mountain View, Calif. 94040

[21] Appl. No.: 797,994

[22] Filed: May 18, 1977

[51] Int. Cl.[2] ..... A63F 3/00

[52] U.S. Cl. ..... 273/273; 273/294

[58] Field of Search ..... 273/130 R, 136 R, 137 D, 273/236, 273, 294, 288

[56] References Cited

U.S. PATENT DOCUMENTS

| | | | |
|---|---|---|---|
| 214,048 | 4/1879 | Macy | 273/137 D |
| 3,638,947 | 2/1972 | Hardesty | 273/137 D |

*Primary Examiner*—Anton O. Oechsle

*Attorney, Agent, or Firm*—Lowhurst & Aine

[57] ABSTRACT

A board game using a game board having seven hexagonal areas of equal size which are arranged such that one of the areas is in the center of six areas symmetrically surrounding the center area. Each of the surrounding areas has one side contiguous with one side of the center area and two sides contiguous with two other areas. Each hexagonal area is divided into six equilateral triangles of equal size. The board game also uses equal size tiles having a shape and size equal to the equilateral triangular area. The thirty-six tiles form six groups of identical tiles each, each group having a different distinctive surface marking which is in the form of dots whose number varies one to six, each group having a different number of dots.

6 Claims, 5 Drawing Figures

BOARD GAME

BACKGROUND OF THE INVENTION

The invention relates to a board game and, more particularly, to a game played with playing tiles of equilateral triangular shapes on a board having a multiplicity of marked subdivisions that are also of equilateral triangular shape.

Board games are well-known and there is an almost infinite variety of such games on the market. There is also a constant search for more challenging games, and for games that combine the best and/or most challenging or exciting features of popular games. Such popular games include dominos, bridge and perhaps liar's dice.

SUMMARY OF THE INVENTION

The present invention is a game that has certain elements of such well-known games as dominos, liar's dice and bridge but with new limitations placed on the tiles and on the procedure. The game of the present invention is played on a board having seven hexagonal areas of the same size, each being subdivided into six equilateral triangles of the same size, and thirty-six tiles of the same size which are shaped to overlie and fill the equilateral triangular areas.

The seven hexagonal areas are arranged such that one is in the center and the others are distributed around it, each having one side contiguous with the side of the centrally located hexagonal area and two sides which are contiguous with two other hexagonal areas. The tiles are formed in six groups, each group having a different distinctive surface marking which can be used for bidding and playing procedures.

DETAILED DESCRIPTION OF THE EMBODIMENT

Figure 1:
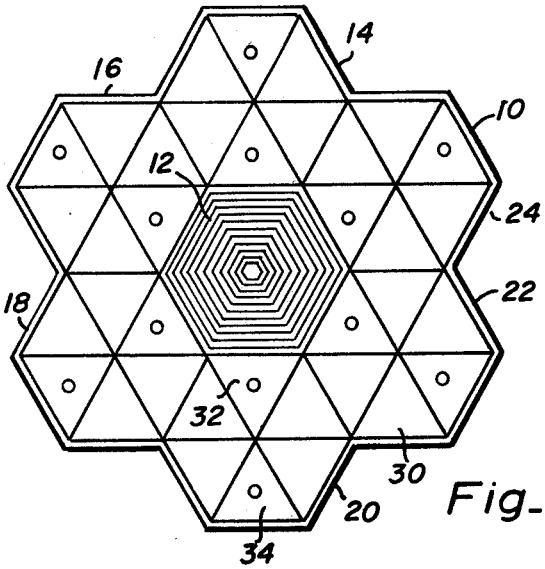
FIG. 1 is a plan view of the game board for playing the game of this invention showing the divisions and the subdivisions by connecting line markings.

Referring now to the drawings, and particularly FIG. 1 thereof, there is illustrated a game board 10 a portion of which is divided, by interconnecting lines into seven hexagonal areas of equal size, namely a central hexagonal area 12 surrounded by six further hexagonal areas 14, 16, 18, 20, 22 and 24. For reasons explained hereinafter, center hexagonal area 12 has a different surface marking than the remaining hexagonal areas which all have the same surface marking. In the illustrated embodiment, the surface marking of the central area is shown as shaded and of the surrounding areas as plain white.

Each hexagonal area is further subdivided, by connecting lines, into six equilateral triangular areas of equal size, one being illustrated at 30. A surface marking, such as the dot, is placed into each of the triangular areas 32 having a side contiguous with the central hexagonal area 12 and into the triangular area 34 which is directly across triangular area 32. Accordingly, there are altogether twelve triangular areas that have a surface marking, such as a dot, which is different than the surface marking of the remaining triangular areas, such as plain, in the surrounding hexagonal areas which number twenty-four.

Figure 2:
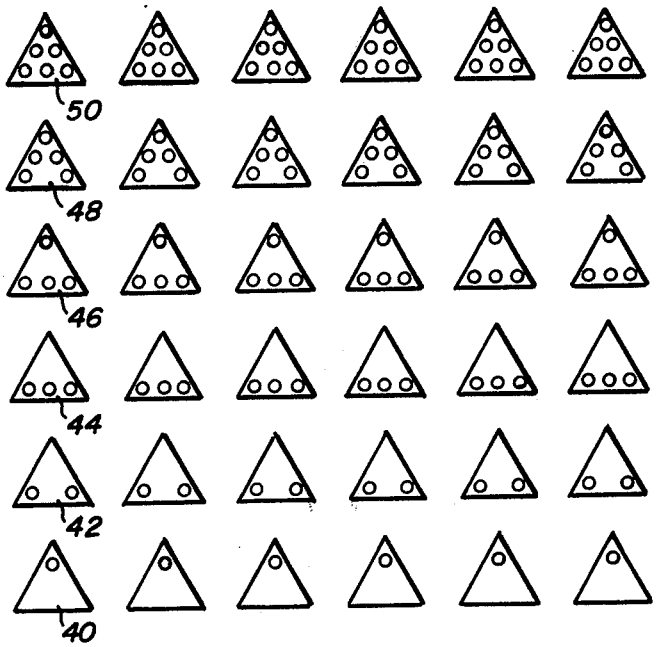
FIG. 2 is a plan view of the thirty-six tiles used for playing the game of this invention using the game board illustrated in FIG. 1 showing the distinguishable surface markings.

Referring now to FIG. 2 of the drawing, there are shown thirty-six equilateral tiles of equal size which form a set of tiles which with the game of this invention is played and which are dimensioned to fit over the triangular areas of the board set at 30. The tiles are divided into six groups of six tiles each, each tile in a group having the same surface marking. The first gorup of tiles, such as 40, has a surface marking in the form of one dot located in what will be called the apex of the triangular tiles. The second group of tiles, such as 42 has two dots located in two apexes of the triangular tiles. Even though the position of the dots may not strictly be "in the apex" it is believed that this description is more accurate and is preferred to calling for two dots along a side of the triangular tile, but either description conveys the approximately location of the surface marking. The third group of tiles, such as 44, has three dots along one side of the tile which can also be described as two dots located in two apexes and one dot midway between these two dots along one side of the tile. The fourth group of tiles, such as 46, has three dots in the three apexes of the tile and one dot midway between two dots along one side of the tile. The fifth group, such as 48, has three dots in the apexes of the tile and two dots midway between the dots along two sides of the tile. The last and sixth group of tiles, such as 50, has six dots, three dots in the three apexes and one dot midway between such dots on each of the three sides of the tiles.

One of the possible games that may be played with board 10 and the tiles illustrated in FIG. 2 is the following. Each player, if not more than four, draws six tiles and thereafter the players start bidding against each other for the "set" which allows the player winning the set to designate the tiles to be used as trumps and the contract that he will produce on the board in number and in kind of tiles he bids. He also makes the first play by placing a trump tile in the shaded center hexagon.

Regarding the bidding, each player tries to determine from the tiles held in his hand, and the response he gets from his partners and opponents, exactly now many tiles of a certain kind have been drawn and will therefore be played during the game. Only tiles actually played on the board count towards completion of a bid, and trumps left in the hand do not count. When bidding, tiles having a one dot indicia are regarded as wild and may therefore have any value.

Bidding can start at any level. Bidders first state the number of tiles they want to bid (count) and then the kind of tiles they are bidding (rank). Thus, 1-2 would be the lowest possible bid and 12-6's would be the highest.

The next player must increase the count or the rank to continue bidding. If he does not want to increase the bid, he must pass.

Example: A bid of 5-4's could be raised by a bid of 5-5's or 5-6's. (This would raise the rank).

A bid of 4-5's could also be raised by bidding 6-2's, 6-3's, 6-3's or 6-4's. (This would raise the count).

When all of the players pass, the bid they pass is declared the winner and the player making that bid is on "set".

Figure 3A:
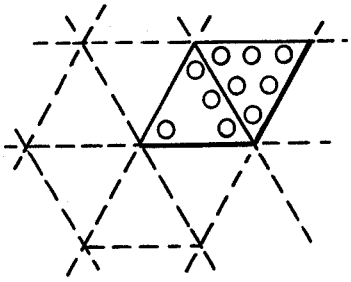
FIGS. 3A, 3B and 3C illustrate how the tiles are arranged or matched during the game on the subdivisions of the board.
Figure 3B:
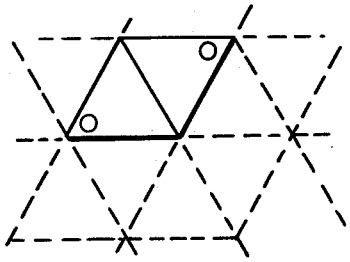
Figure 3C:
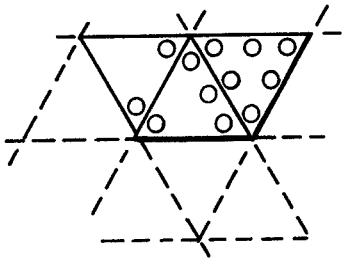

After a bid is arrived at, the playing starts. The winning better who is on "set" has the opening play and he must place a trump tile in one of the triangular areas in the shaded center hexagon. FIG. 3A illustrates a four indicia trump that has been placed in the center area. The next player in turn must match side-by-side such as playing a six dot indicia tile also illustrated in FIG. 3A. Not only need dots be matched along side, but a side having no dots may also be matched as shown in FIG. 3B. Another illustration in FIG. 3C shows three tiles being played with sides being identical.

It should now be apparent that the game board and the playing tiles of the present invention provide a challenging and intriguing combination of competitive game possibilities including some of the theories of dominos, of bridge and of poker or liar's dice.

The shape of the tiles, placement of the markings and the special configuration of the playing board permits the design of a game that is enjoyable and challenging whether it is played with simple skill by beginners, or with sophisticated strategy by experienced players.

Since the scoring rules award points for a completed bid contract, a loss of points if the contract is not made and penalties if trumps are left in a hand when the game is over, the player must continually assess the advantages of playing their trumps - thus helping the bidder, or withholding them and suffering a penalty if they are caught with the trumps at the end of the game.

Players are awarded points for completing a hexagon and also for being the first to play all of their tiles. Unfortunately, when a player completes a hexagon he must add a tile to his hand, thus creating a dilemma.

The game affords many opportunities for offensive and defensive strategy. However, the players must always face the conflict between scoring and long range success. It is a game of skill, the subtleties increase as the players become experienced.

While one preferred form of board and playing tiles has been described, the invention is not limited to that one form, other combinations will be readily apparent. Furthermore, a complete set of playing rules has not been presented because many possible rules can be devised and the demonstrated rules, even though only sketchily outlined, give an example of the utility that this board game has.

What is claimed is:

1. A board game comprising:

a board having a surface which is divided, by connecting line markings on said board surface, into exactly seven hexagonal areas of equal size, all hexagonal areas being contiguous on at least three sides with at least three others of said hexagonal areas;

each of said hexagonal areas being subdivided into six equilateral triangular areas of equal size;

thirty-six playing tiles of the same size and geometrical configuration as said triangular areas;

said playing tiles forming six groups with different distinctive surface markings, each group including six tiles having identical surface markings.

2. A board game according to claim 1 in which the distinctive surface markings of said six groups of tiles comprise:

one dot in an apex of the tiles of the first group;

one dot in each of two apexes of the tiles of the second group;

one dot in each of two apexes and one dot midway between the two dots in the tiles of the third group;

one dot in each of the three apexes and one dot midway between the apexes along one of the tiles forming the fourth group;

one dot in each of the three apexes and one dot each midway between two apexes along two sides of the tiles forming the fifth group; and one dot in each of the three apexes and one dot each midway between the apexes along all three sides of the tiles forming the sixth group.

3. A board game accordng to claim 1 in which one of said hexagonal areas is located at the center of the board surface and the remaining six hexagonal areas are symmetrically distributed around the center area, each of said six hexagonal areas having one side contiguous with different sides of said central area and two sides contiguous with two adjacent hexagonal areas.

4. A board game according to claim 3 in which said central area has a different surface marking than the surrounding six areas.

5. A board game according to claim 4 in which the triangular area in the six surrounding hexagonal areas, which have a side contiguous with a side of central hexagonal area, and the triangular area lying directly across the last defined triangular area, have distinctive surface markings which are different than the surface marking in the remaining triangular areas in the hexagonal areas surrounding the central hexagonal area.

6. A board game according to claim 1 in which the distinctive marking of said six groups of tiles comprises, respectively, one, two, three, four, five and six dots.

* * * * *